United States Patent [19]

Aronson et al.

[11] Patent Number: 4,989,358

[45] Date of Patent: Feb. 5, 1991

[54] HAND GUN BRACE FOR CONVERTING A SIDE HANDLE BATON TO HAND GUN STOCK

[76] Inventors: Martin J. Aronson; Penny L. Aronson, both of 1479 Hwy. 2, West, Kalispell, Mont. 59901

[21] Appl. No.: 450,449

[22] Filed: Dec. 14, 1989

[51] Int. Cl.[5] ..... F41A 21/00

[52] U.S. Cl. ..... 42/72

[58] Field of Search ..... 42/72; 273/84 R

[56] References Cited

U.S. PATENT DOCUMENTS

| | | | |
|---|---|---|---|
| 1,554,556 | 9/1925 | Camus | 42/72 |
| 1,557,865 | 10/1925 | Neet et al. | 42/72 |
| 1,877,016 | 9/1932 | Munson | 42/72 |
| 3,685,194 | 8/1972 | Coon | 42/77 |

*Primary Examiner*—Charles T. Jordan
*Assistant Examiner*—Rochelle Lieberman
*Attorney, Agent, or Firm*—George M. Cole

[57] ABSTRACT

An adapter brace device (10) for removably fitting onto one end of a policeman's side handle baton (12) for bracing a handgun while the baton itself is used as a shoulder stock. The adapter device includes a round, plastic body portion (14) with an inner end (16) and an outer end (18). The inner end (16) of the body (14) includes a recessed opening (20) and the outer end has a cradle portion (28) which angles upwardly and outwardly and which cradle portion has a concave depression (26) for receiving the back edge of the grip of a handgun (G). The adapter brace fits on to the end of the baton as shown.

8 Claims, 2 Drawing Sheets

HAND GUN BRACE FOR CONVERTING A SIDE HANDLE BATON TO HAND GUN STOCK

DESCRIPTION

1. Technical Field

The invention relates generally to the field of stocks for firearms and more particularly to a brace means which attaches to one end of a side handle baton commonly carried by law enforcement officers and referred to as a "billy club" for bracing and aiming a hand gun so that the shooter will have more accuracy if required to fire the weapon.

2. Background Art

As those skilled with firearms, particularly law enforcement officers, are aware the incidents during which shooting of fire arms takes place are occurring at greater distances. An officer does not always have a rifle at his side for the exchange of weapons fire at longer distances. Thus, if the officer does not have a rifle it may be critical if not life-saving to have means at his disposal to make his hand gun more accurate.

As a matter of historical interest in the 1930's after the gangster era, Congress outlawed Thompson submachine guns, sawed off shot guns and shoulder stock hand guns which were cartridge fed. These weapons still are illegal except by special permit. In the case of hand guns, a shoulder stock hand gun is still illegal if the stock "attaches" to the piece. In that era most shoulder stock hand guns were produced in Europe and were semi to full automatic and thus were literally machine guns. Accordingly cartridge fed shoulder stock hand guns were classified with machine guns.

The prior art has seen the development of devices which are not "attached" to the hand gun for bracing the same to assist the shooter in acquiring greater accuracy.

Among the prior art devices directed to a brace for supporting and aiming a hand gun are U.S. Pat. No. 3,553,878 to Canon. This patent discloses an extendible bar in a housing with the bar at its outer end having a strap or flexible band to brace the hand, finger or thumb of the individual. This device is not intended to be engaged by the grip of the hand gun, but by the shooter's hand. This is probably most pertinent to the disclosure of this invention since it functions as a brace rather than a stock.

A number of other patents disclose structures which predate the cartridge fed shoulder stock hand gun restrictive legislation. Thus, the following devices are of interest but not particularly relevant to the teaching of the instant invention since the devices attach and therefor act as stocks. They are the following U.S. Pat. No's:

1,557,865 which is a holster which also acts as a stock extension; 1,554,556 which attaches the butt of the pistol grip to the holster which acts as an extension;

1,266,632 and 1,266,633 which strap the pistol grip to the extension; 3,641,694 which shows attachment means for securing the hand gun to a its holster; and 723,545 which discloses another holster-stock combination but which indicates that the grip of the pistol is detachably secured to the narrow end of the holster as stock extension.

As mentioned above none of the cited references anticipates the structure of the adapter brace of the instant invention.

DISCLOSURE OF THE INVENTION

The invention embraces a firearm brace device for side handle batons commonly carried by police and other law enforcement officers. The baton itself acts as a stock while the brace device of the invention adapts to cradle the rear of the hand grip. The brace device of this invention has a rear opening for sliding tightly onto one end of the side handle baton. The front end of the device forms an angled concave cradle against which the back of the pistol grip is braced to so that the weapon is held much more firmly by the shooter's hand. Thus, the shooter's aim or point on accuracy is greatly enhanced.

Accordingly it is among the features of the invention that it does not comprise an illegal "attached" stock extension but is an adapter for a side handle baton which functions as the stock. The device allows the officer to utilize a standard item of police equipment. The adapter is small, easy to carry, simple and yet extremely functional in that it enhances firearm accuracy and thus may save an officer's life. The invention is uniquely simple and inexpensive and increases the safety for an officer who finds himself or herself in a shooting situation in which he or she is without a rifle.

BEST MODE FOR CARRYING OUT THE INVENTION

Figures 1, 1A:
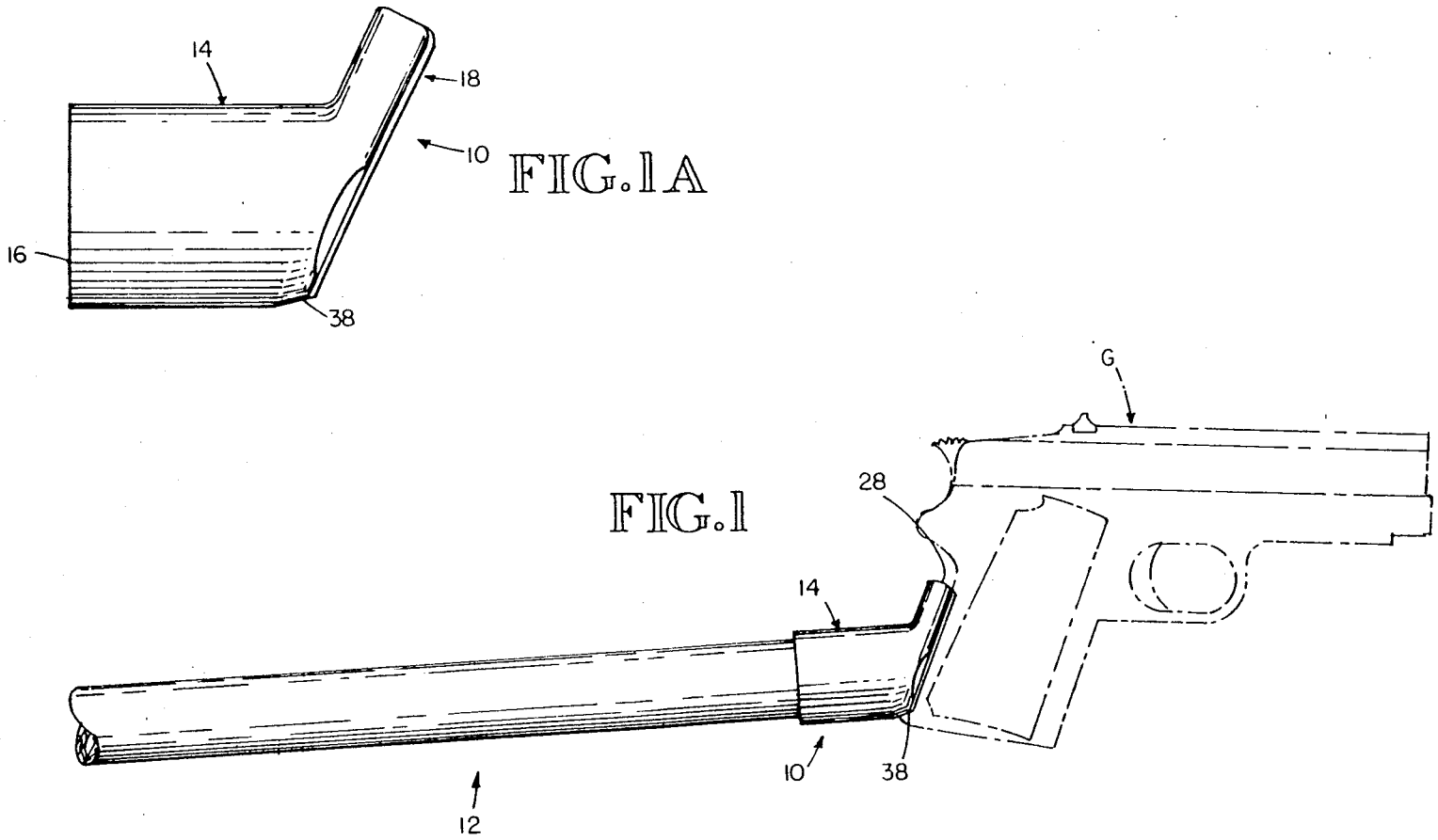
FIG. 1 is a side view in elevation of the adapter device mounted on the end of a side handle baton to receive a hand gun.
FIG. 1A is a side elevational view of the adapter brace showing details of its construction.
Figure 4:
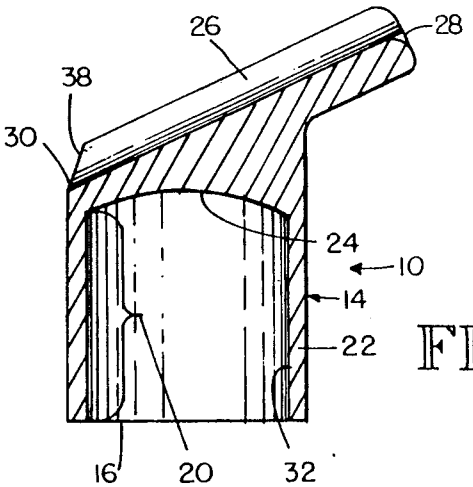
FIG. 4 is a a view in cross section of the adapter device showing additional details of its structure.
Figure 5:
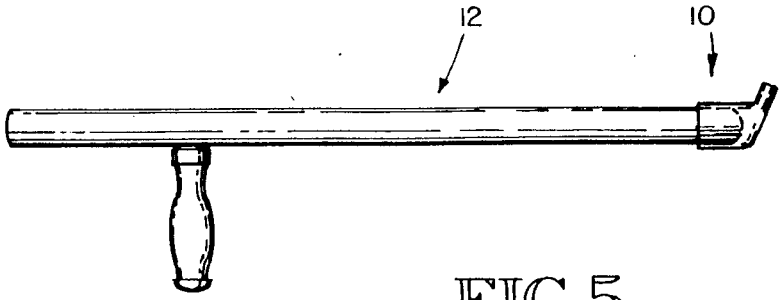
FIG. 5 is an elevational view of the adapter brace on a side handle baton.
Figure 3:
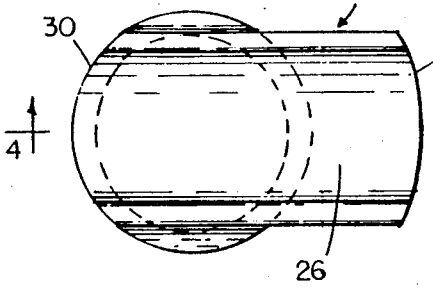
FIG. 3 is a view from the front of the adapter showing additional details of its structure.
Figure 2:
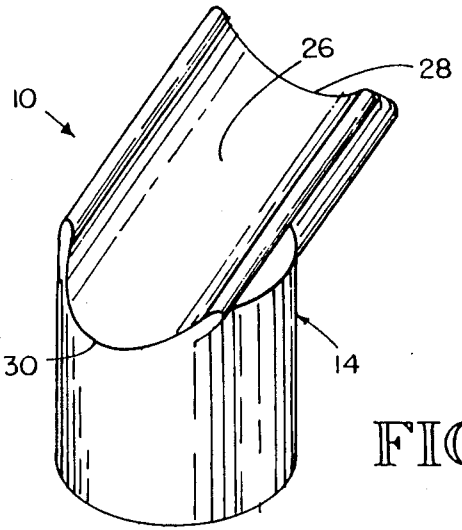
FIG. 2 is a view in perspective of the invention showing additional details of the cradle portion for receiving the butt or grip of a pistol.

Referring now to the drawings it will be seen that the adapter device of this invention, generally designated by the number 10, is a round, plastic article with limited, inherent resilient flexing properties and which is shaped to slip onto but also tightly fit onto the end of a side handle baton generally designated by the number 12. The plastic material of which the body is made preferrable will be made of neoprene or the like with a rubber-like or tacky surface. It can be appreciated that the plastic cannot be slick or slippery allowing the handgun grip to slip when it is being held against the adapter brace. Additionally, it is desirable that the body material not be so hard as to mar the grip surface of the handgun. G shown in phantom lines in the position in which it will be held with respect to the adapter brace 10. Also a slight bevel 38 is located at the lower end of the bracing surface 26.

The adapter 10 has a generally round main portion generally designated by the number 14 and which includes inner end 16. The main body portion 14 has recess 20 formed into the body from inner end 16 to define cylindrical wall 22 and bottom surface 24 with the wall 22 having interior surface 32.

The outer end of the adapter 10 has an angled cradle portion 18 which includes a concave, generally straight bracing surface 26 with a tip end 28. It will be noted that the cradle portion 18 extends from the edge 30 at what is the lower rear edge of the cradle to the upper edge 28. Note that the tip edge or end 28 extends outwardly past the exterior surface of the body portion 14 about an inch though this particular dimension may vary. The primary purpose is to insure that the back surface of the hand grip have sufficient bracing surface behind it in the cradle portion of the adapter.

It will be appreciated that the adapterd device slips onto the end of the side handle baton as shown where the rear of a handle grip is held against the adpater device.

We claim:

1. Adapter brace device for handguns having a hand grip with a back edge to be used with a side handle baton, comprising:

a plastic body of predetermined length adapted to be removably attached to one end of a side handle baton means and including an inner end an outer end, said body at its inner end having a recess opening of a predetermined size extending into said body a predetermined depth to form a mounting portion having a predetermined cross sectional shape of predetermined dimensions so that said body can be adapted to slip securely onto the end of said side handle baton means for non-rotational movement for bracing a gun held by an individual using said side handle baton as a stock, the outer end of said body having an angled cradle portion to be engaged by the back edge of the gun's hand grip, said cradle portion when said body is in position extending generally upwardly and outwardly at a predetermined angle and forming a generally straight concave depression, said body being adapted to slip off the end of said baton when not in use.

2. The adapter brace device according to claim 1 and in which said cradle portion is of a predetermined length.

3. The adapter brace device according to claim 1 and wherein said plastic body contains a predetermined amount of inherent, limited ability to flex resiliently.

4. The adapter brace device according to claim 1 and wherein said body and said recess opening are generally round in cross sectional shape.

5. The adapter brace device according to claim 1 and wherein said recess opening and said concave depression are spaced apart from each other within said body.

6. The adapter brace device according to claim 3 and wherein said cradle portion extends outwardly beyond said cylindrical wall such that it forms a tip edge extending a predetermined distance beyond the exterior surface of said body.

7. The adapter brace device according to claim 5 and wherein said body and said recess opening are generally round in cross sectional shape.

8. The adapter brace device according to claim 7 and wherein said recess opening and said concave depression are spaced apart from each other within said body.

* * * * *